US005742020A

United States Patent [19]

Adachi et al.

[11] Patent Number: 5,742,020

[45] Date of Patent: Apr. 21, 1998

[54] VALVE SEAT-BONDED CYLINDER HEAD AND METHOD FOR PRODUCING SAME

[75] Inventors: Shuhei Adachi; Junichi Inami, both of Iwata, Japan

[73] Assignee: Yamaha Hatsudoki Kabushiki Kaisha, Iwata, Japan

[21] Appl. No.: 483,246

[22] Filed: Jun. 7, 1995

[30] Foreign Application Priority Data

Jan. 23, 1995 [JP] Japan ..... 7-027300
Mar. 31, 1995 [JP] Japan ..... 7-076623

[51] Int. Cl.[6] ..... B23K 11/20

[52] U.S. Cl. ..... 219/78.01; 219/118; 29/888.44; 29/888.46; 228/195

[58] Field of Search ..... 219/78.02, 118; 29/888.4, 888.44, 888.46; 228/193, 194, 195; 123/188.8

[56] References Cited

U.S. PATENT DOCUMENTS

| | | | |
|---|---|---|---|
| 3,667,110 | 6/1972 | Gwyn | 228/193 |
| 3,769,101 | 10/1973 | Woodward | 228/194 |
| 3,944,777 | 3/1976 | Porat | 219/118 |
| 4,046,305 | 9/1977 | Brown et al. | 228/194 |
| 4,273,983 | 6/1981 | Ogawa et al. | 219/118 |
| 4,734,968 | 4/1988 | Kuroishi et al. | 29/888.44 |
| 5,054,682 | 10/1991 | Mistry | 228/194 |
| 5,060,374 | 10/1991 | Findlanl et al. | 29/888.44 |
| 5,330,097 | 7/1994 | Inoue | 228/194 |

FOREIGN PATENT DOCUMENTS

| | | |
|---|---|---|
| 0092683 | 11/1983 | European Pat. Off. . |
| 2263381 | 10/1975 | France . |
| 53-13845 | 5/1977 | Japan . |

*Primary Examiner*—Teresa J. Walberg
*Assistant Examiner*—J. Pelham
*Attorney, Agent, or Firm*—Knobbe, Martens, Olson & Bear LLP

[57] ABSTRACT

A valve seat-bonded cylinder head, in which a valve seat is bonded to a cylinder head unit, which valve seat is formed of material different from and harder than that of said cylinder head unit, wherein the valve seat is bonded to the cylinder head unit by solid-state diffusion, without forming a melting reaction layer therebetween, and a plastic deformation layer is formed on the bonding boundary at least on the cylinder head unit side, thereby allowing for an increase in the bonding strength, and reduction in the size of the valve seat area.

28 Claims, 20 Drawing Sheets

Passing electric current

Placing

Pressing

Passing electric current

Discontinuing electric current

Releasing pressure

Machining

VALVE SEAT-BONDED CYLINDER HEAD AND METHOD FOR PRODUCING SAME

BACKGROUND

1. Field of the Invention

This invention relates to a cylinder head for internal combustion engines, provided with valve seats bonded thereto, and in particular, to such a cylinder head allowing for an increase in the bonding strength, and reduction in the size of the valve seat area. This invention also relates to a method for producing the valve seat-bonded cylinder head.

2. Background of the Art

In conjunction with internal combustion engines, it is the practice to employ light alloy casting for the cylinder head. In order to permit more wear-resistant, longer-lived operation, it has been the practice to provide an annular insert at the termination of the gas flow ports which serves as the seating surface for the poppet valve that controls the flow through the gas port. It is extremely important that the insert piece be well retained in the cylinder head for obvious reasons. It is generally the common practice to press fit the valve seat into the cylinder head. Although such press fitting operations normally provide good initial attachment, certain problems can occur during operation of the engine, particularly as a result of the thermal stresses due to the differences in degrees of thermal expansion between the cylinder head and the valve seat insert and also as a result of the initial stresses in the cylinder head and insert caused during installation. Further, in order to securely fit the valve seat insert into a recess of the cylinder head, the recess must be large enough to have structural strength, thereby interfering with reducing the size of cylinder heads.

Where the engine is provided with multiple valves the amount of cylinder head material between adjacent valve seats may be extremely small and this gives rise to a problem of cracking. In addition, the bond between the cylinder head material and the valve seat can also become damaged either on installation or during running operation.

In order to resolve the above problems, a laser cladding technique has been developed (Japanese patent application laid-open No. 62-150014 (1987), No. 62-150014 (1987) and No. 2-196117 (1990)), in which valve seat material which has heat, abrasion, and corrosion resistance is welded into a cylinder head unit with a laser beam to form a cladding layer which functions as a valve seat. However, in the above method, a blow hole or a shrinkage cavity tends to occur in the vicinity of the bonding boundary, since the material of the cylinder head unit undergoes fusion as well as solidification, and productivity is low.

SUMMARY OF THE INVENTION

The present invention has exploited bonding performance of a valve seat with a cylinder head unit. An objective of the present invention is to provide a valve seat-bonded cylinder head unit, without melting the material of the cylinder head unit nor that of the valve seat, which allows for increasing the bonding strength, and reducing the size of the valve seat area.

Namely, one important aspect of the present invention is a valve seat-bonded cylinder head, in which at least valve seat is bonded to a cylinder head unit, said valve seat being formed of material different from and harder than that of said cylinder head unit, wherein said valve seat is bonded to said cylinder head unit by solid-state diffusion, without forming a melting reaction layer therebetween, and a plastic deformation layer is formed on the bonding boundary at least on the cylinder head unit side. By realizing solid-state diffusion effected by formation of a plastic deformation layer, bonding strength between the valve seat and the cylinder head unit is surprisingly and unexpectedly increased, despite the fact that no melting reaction layer is formed. In addition, since the bonding results neither from the recess configuration nor the valve seat configuration, the area around the valve seat in the cylinder head unit can be reduced, thereby realizing a compact cylinder head.

In the above valve seat-bonded cylinder head, the valve seat is typically made of an Fe-based sintered alloy, and the cylinder head unit is typically made of an aluminum alloy. Further, the valve seat preferably has metal deposits (such that made of Cu) capable of forming an eutectic alloy with the cylinder head unit, so that the metal deposits and the material of said cylinder head unit undergo solid-state diffusion. The solid-state diffusion may take place between the material of the valve seat and the material of the cylinder head unit without the metal deposits. However, when the metal deposits are present, it is possible to obtain a high level of bonding strength. In this case, although an eutectic alloy may be formed between the metal deposits and the material of the cylinder head unit in a molten state, interestingly, the alloy is completely repelled from the bonding boundary, and bonding by solid-state diffusion can be achieved on the bonding boundary.

As another aspect of the valve seat-bonded cylinder head, the level of a chemical component essentially present in said plastic deformation layer (such as Fe, Cu and Ni in the case of the cylinder head unit made of an aluminum alloy) is substantially constant in the region in said plastic deformation layer which is preferably farther than 10 μm from said bonding boundary in perpendicular direction with respect to the plane of said bonding boundary. An intermetallic compound layer is normally formed in a region within 10 μm of said bonding boundary. By limiting the thickness of such an intermetallic compound as above, bonding strength can be conspicuously increased.

Another important aspect of the present invention is a method for producing the above-mentioned valve seat-bonded cylinder head, characterized by the step of impressing a voltage between said convex surface of said valve seat insert and that of said cylinder head unit while pressing said valve seat insert against said cylinder head unit, in such a way that a plastic deformation layer is formed on the joining boundary at least on said cylinder head unit side, thereby bonding said valve seat insert and said cylinder head unit by solid-state diffusion, without forming a melting reaction layer therebetween. By the above method, in particular, when the valve seat is coated with metal deposits (such that made of Cu, Zn, Sn and Ag in the case of an aluminum alloy used in the cylinder head unit) capable of forming an eutectic alloy with the cylinder head unit, especially in a combination with Cu with which the valve seat is impregnated, bonding by solid-state diffusion can be efficiently and duly achieved on the bonding boundary. When the thickness of the coating of the metal deposits is 1–30 μm, bonding strength is significantly increased.

DETAILED DESCRIPTION OF THE PREFERRED EMBODIMENT

Figure 1:
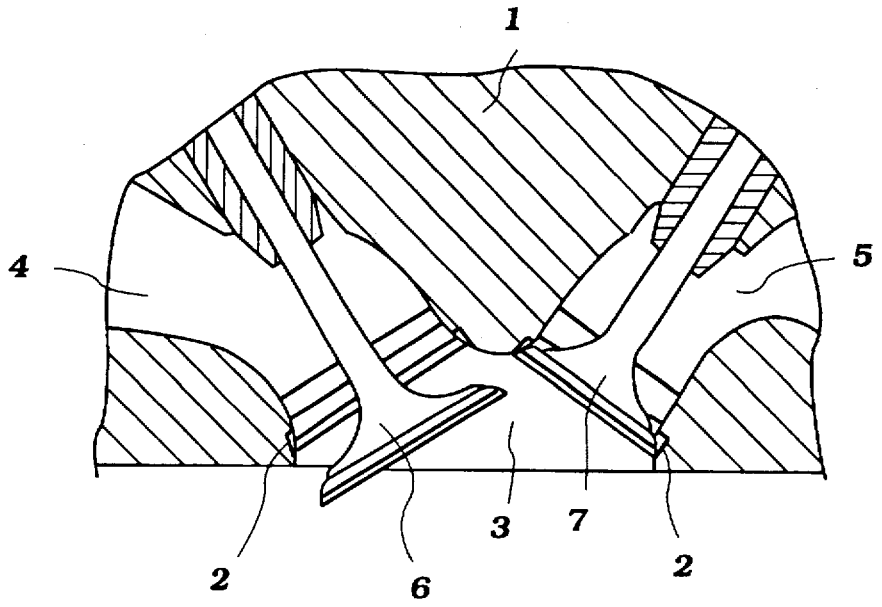
FIG. 1 is a schematic cross-sectional partial view showing the main part of one embodiment of a cylinder head of the present invention.

Bonding Of Valve Seat To Cylinder Head Unit

In the present invention, firm bonding between a valve seat and a cylinder head unit is interestingly effected by solid-state diffusion or metallic bonding. In other words, on the bonding boundary, a melting reaction layer such as an alloy-forming layer is not substantially present.

The nature of the solid-state diffusion (metallic bonding) is essentially different from a mechanical connection resulting in the discontinuous connection of the material which is not associated with the atomic diffusion. Further, it is different from another method of metallic fusion such as the resistance-welding method, wherein both materials are partially melted so as to form an alloy solution by utilizing heat generated by the contact resistance on the surface, and the application of electricity is then discontinued so as to cool the solution. Namely, solid-state diffusion in a cylinder head is characterized by the production of a continuous structure by atomic counter diffusion on the bonding boundary, without forming a melting reaction layer between two different materials, while maintaining the solid phase state of both materials. Thus, the solid-state diffusion (metallic bonding) in the present invention is not associated with phase transformation such as melting (fusion) and solidification. In the case that metal deposits capable of forming an eutectic alloy with a cylinder head unit are used as a coating on a valve seat insert, although an eutectic alloy may be formed in a molten state while bonding is in progress, the eutectic alloy does not stay on the bonding boundary so that the alloy is in no way involved in bonding between the valve seat and the cylinder head unit. The alloy is repelled from the bonding boundary while bonding is in progress. As a result, solid-state diffusion can be achieved on the bonding boundary, with the use of the metal deposits, thereby obtaining a high strength bond. Solid-state diffusion can be achieved between the material of a valve seat and that of a cylinder head unit.

Bonding by solid-state diffusion is associated with formation of intermetallic compounds. When the thickness of the intermetallic compounds is 20 μm or less (10 μm on both sides of the bonding boundary), preferably 10 μm or less, bonding by solid-state diffusion can be strengthened. In the intermetallic compound layer, the level of chemical components present in the material of a cylinder head unit (such as Fe, Cu and Ni) is drastically changed, i.e., from the level in the material of a cylinder head unit to that in the material of a valve seat.

In any event, the foregoing structure is obtained by exerting pressure on the cylinder head unit so as to form a plastic deformation layer at least on the cylinder head unit side. That is achieved by impressing a voltage between the cylinder head unit and the valve seat while exerting pressure on the surface of the cylinder head unit to which the valve seat is bonded.

Method For Bonding Valve Seat To Cylinder Head Unit

In brief, a valve seat-bonded cylinder head of the present invention can be produced by a method comprising the steps of: (a) placing at least valve seat insert having a convex surface as a bonding surface on a convex surface of a cylinder head unit, in which said convex surface of said valve seat insert is attached to said convex surface of said cylinder head insert; (b) impressing a voltage between said convex surface of said valve seat insert and that of said cylinder head unit while pressing said valve seat insert against said cylinder head unit, in such a way that a plastic deformation layer is formed on the joining boundary at least on said cylinder head unit side, thereby bonding said valve seat insert and said cylinder head unit by solid-state diffusion, without forming a melting reaction layer therebetween; (c) cooling the resulting cylinder head unit to which said valve seat insert has been bonded; and (d) machining the resulting valve seat-bonded cylinder head. The timing of initiation of pressure and electric current will be described later.

In particular, when the valve seat has metal deposits capable of forming an eutectic alloy with the cylinder head unit, bonding by solid-state diffusion can be efficiently achieved, so that the metal deposits and the material of the cylinder head unit undergo solid-state diffusion. As a material for a valve seat, an Fe-based sintered alloy is preferably used in view of strength and abrasion resistance. The sintered alloy has a porous structure. When Cu is deposited in the pores, bonding by solid-state diffusion can be more efficiently achieved. In a combination with the use of the above Cu, the use of metal (such as Cu, Zn, Sn and Ag in the case of an aluminum alloy used in the cylinder head unit) capable of forming an eutectic alloy with the cylinder head unit in a coating form is highly preferable. When the thickness of the coating is 1–30 μm, bonding by solid-state diffusion is startlingly improved.

EXAMPLE 1

Plastic Deformation Layer And Intermetallic Compound In Bonding Area

Production Process of Valve Seat-Bonding Area

FIG. 1 illustrates the main part of one embodiment of the cylinder head of the present invention. A dome-like combustion chamber 3 is provided below a cylinder head unit 1, wherein an intake port 4 and exhaust port 5 open to the combustion chamber 3. At opening rims of the intake and exhaustion ports 4 and 5, ring-shaped valve seats 2 are integrally provided with the cylinder head unit 1 as part of the cylinder head so that an intake valve 6 and exhaust valve 7 are closely attached in the closed positions, wherein the valve seats 2 are made of a different material from the cylinder head unit 1.

Figure 2:
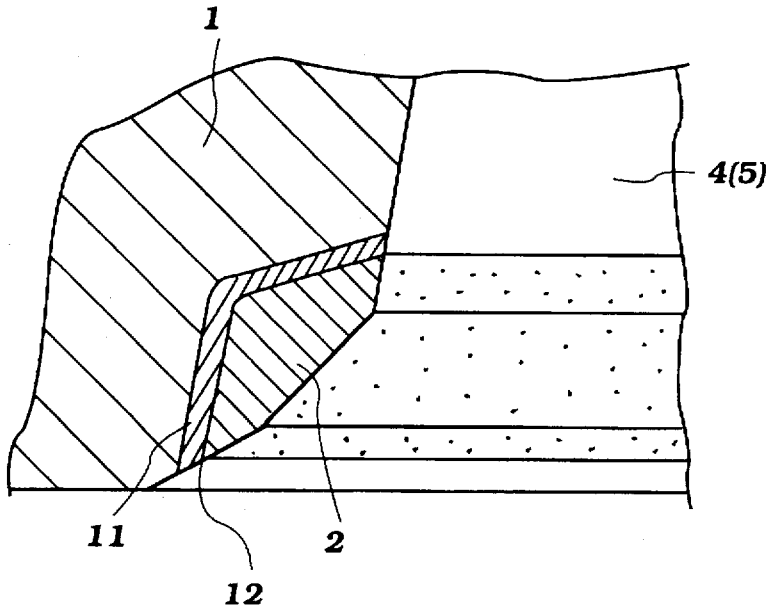
FIG. 2 is a schematic vertical cutaway partial view illustrating one embodiment of the valve seat of the cylinder head depicted in FIG. 1.

FIG. 2 is a partially enlarged cross-sectional view of the valve seat 2 of the cylinder head. The cylinder head unit 1 has a cast structure made of aluminum alloy. The valve seat 2 is made of iron-based sintered alloy. The cylinder head unit 1 and valve seat 2 are metallically bonded (i.e., bonded by solid-state diffusion) by a bonding boundary 12, wherein the cylinder head unit 1 contains a plastic deformation layer 11 made of aluminum alloy along the bonding boundary 12.

The plastic deformation layer 11 at the side of the cylinder head unit 1 is comprised of deformed and warped dendritic or prismatic crystals which are characterized in the cast structure. The plastic deformation layer 11 is characterized in that the aspect ratio of eutectic silicon particles is large, and the dislocation density is high due to the dislocation caused by the deformation. Further, its hardness is increased by the processed hardness.

In the following, we will discuss one preferred embodiment of a method to integrally produce the cylinder head unit 1 and valve seat 2 for the cylinder head having the above-described bonding structure of the valve seats.

Figure 3:
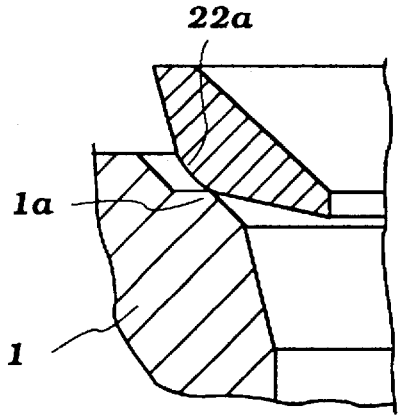
FIG. 3 is a schematic vertical cutaway partial view illustrating one embodiment of a step of a method for integrally producing a cylinder head unit and a valve seat, in which a seat ring member is set on the cylinder head unit.

As shown in FIG. 3, a seat ring member 22 is set on the cylinder head unit 1. In the preferred embodiment, a convex portion 1*a* is provided in the cylinder head unit 1 at a part facing the seat ring member 22 and eventually forming the bonding boundary. On the other hand, a rounded convex portion 22*a* is provided on the seat ring member 22 at a part forming the bonding boundary.

Figures 6A, 6B, 6C:
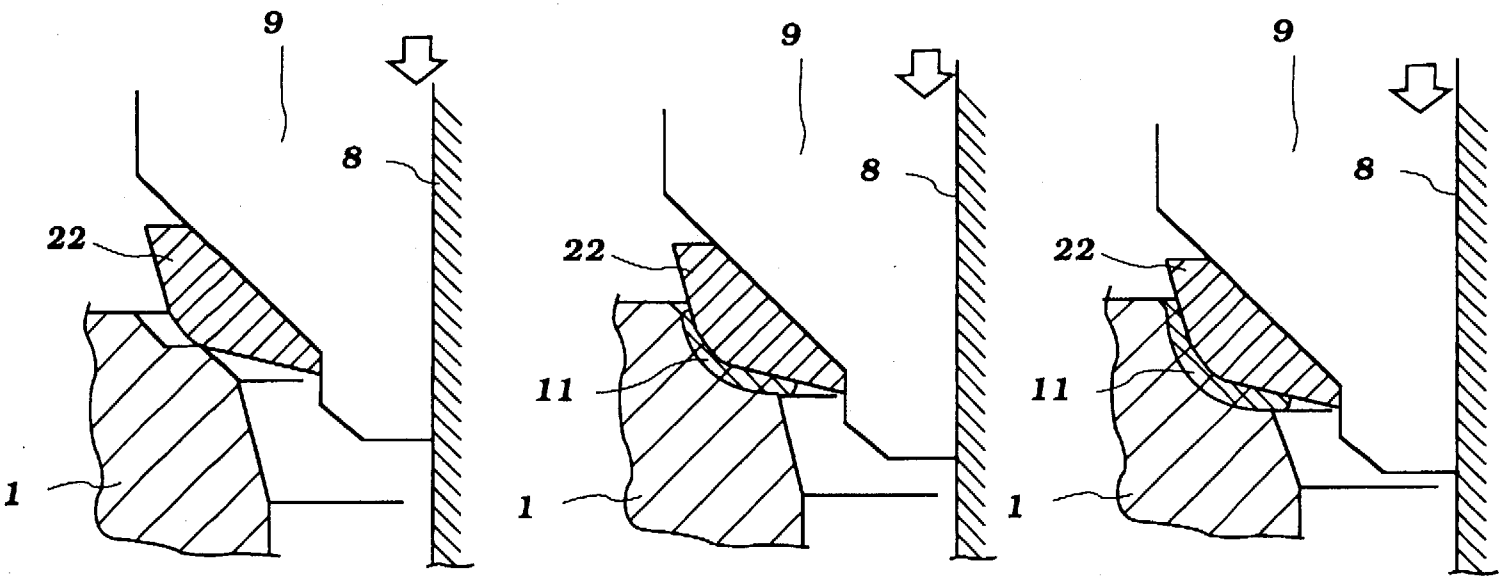
FIG. 6 is a schematic vertical cutaway partial view illustrating one embodiment of a step of a method for integrally producing the cylinder head unit and valve seat, in which electricity is applied to the seat ring member by pressing an electrode to the cylinder head unit along a guide bar, and the cylinder head is treated in the order, (A), (B) and (C).
Figure 10:
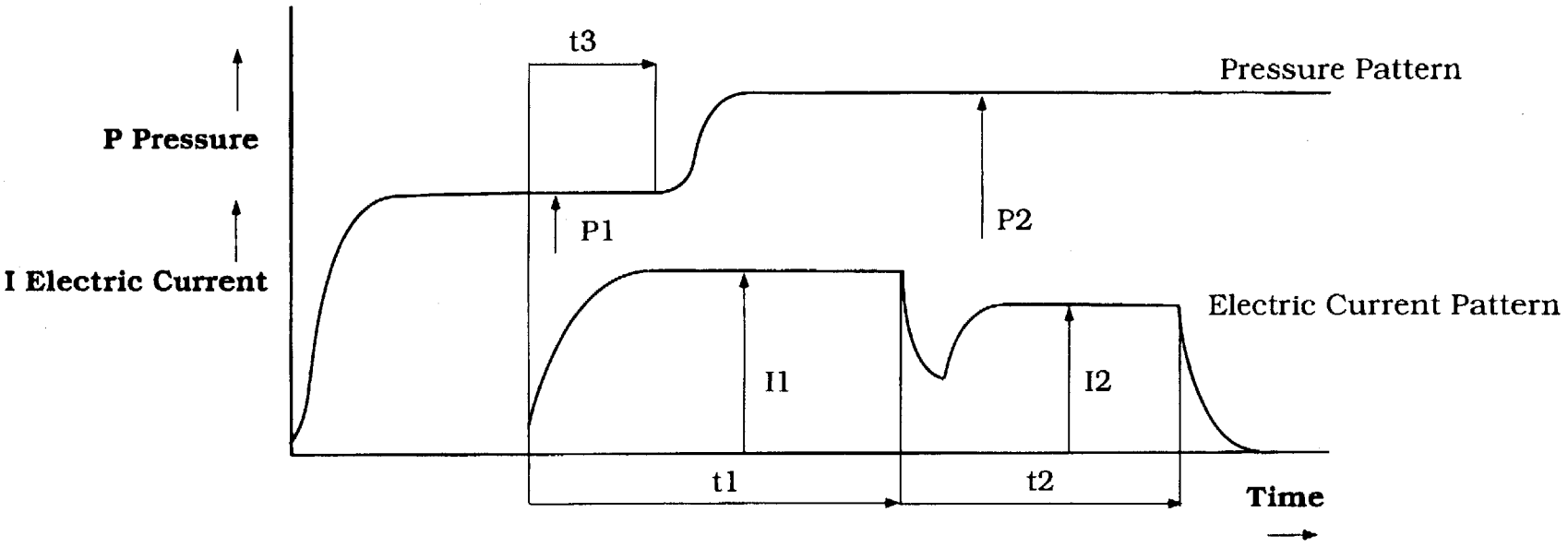
FIG. 10 is a schematic chart illustrating one example of the conditions on which electricity is applied to the seat ring member by pressing an electrode to the cylinder head unit along a guide bar.
Figure 11:
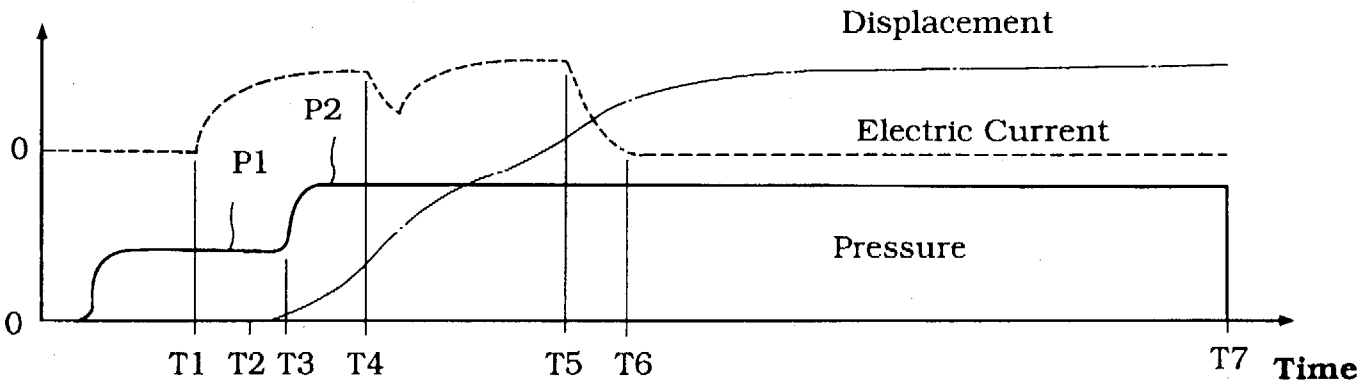
FIG. 11 is a schematic chart illustrating another example of the conditions on which electricity is applied to the seat ring member by pressing an electrode to the cylinder head unit along a guide bar.

First, the seat ring member 22 is set on the cylinder head unit 1 while the convex portion 22*a* is facing the convex portion 1*a*. Then, as shown in FIGS. 6(A)–(C), the electricity is applied to the seat ring member 22 by pressing an electrode 9 to the cylinder head unit 1 along a guide bar 8 based on the condition illustrated in FIG. 10. Another example of timing of exerting pressure and electric current is shown in FIG. 11, in which the degree of depression of the cylinder head unit surface is also indicated. In the Figure, the degree of depression was measured by a laser displacemeter.

As shown in FIGS. 6(B)–(C), the cylinder head unit 1 having smaller deformation resistance than the seat ring member 22 is deformed. The seat ring member 22 is then embedded in the rim of the cylinder head unit 1 and connected with the cylinder head unit 1. As a result, the deformation layer 11 is formed on the cylinder head unit 1 along the bonding boundary 12 of the seat ring member 22.

Figure 4:
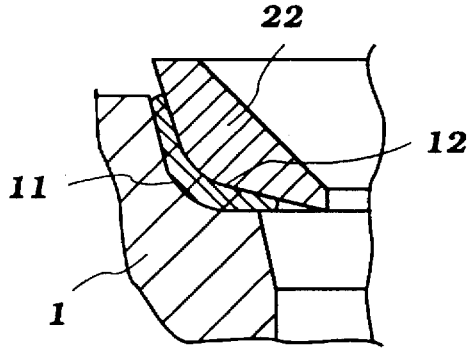
FIG. 4 is a schematic vertical cutaway partial view illustrating one embodiment of a step of a method for integrally producing the cylinder head unit and valve seat, in which a finishing cutting process is applied to the cylinder head unit bonded to the seat ring member by solid-state diffusion.
Figure 5:
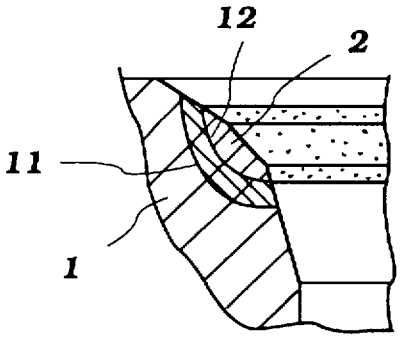
FIG. 5 is a schematic vertical cutaway partial view illustrating one embodiment of a step of a method for integrally producing the cylinder head unit and valve seat, in which the valve seat made of a different material than the cylinder head unit is integrally formed with the bonding boundary through a deformation layer.

As shown in FIG. 4, after cooling, a finishing cutting process is applied to the cylinder head unit 1 which is bonded to the seat ring member 22 by solid-state diffusion. Thus, as shown in FIG. 5, the valve seat 2 made of a different material than the cylinder head unit 1 is integrally formed with the bonding boundary 12 through the deformation layer 11.

Figure 7:
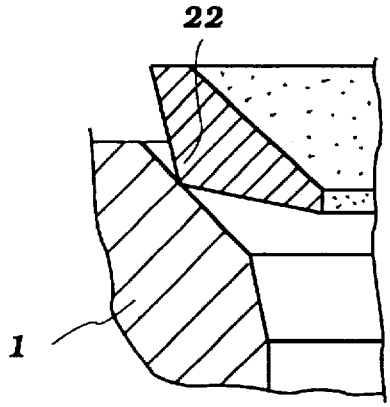
FIG. 7 is a schematic vertical cutaway partial view illustrating another embodiment of arrangement of the cylinder head unit and seat ring member adopted for the present invention.
Figure 8:
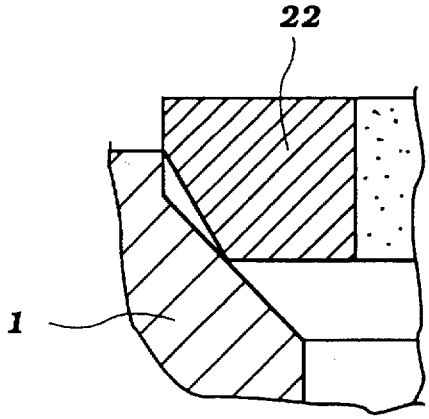
FIG. 8 is a schematic vertical cutaway partial view illustrating another embodiment of arrangement of the cylinder head unit and seat ring member adopted for the present invention.
Figure 9:
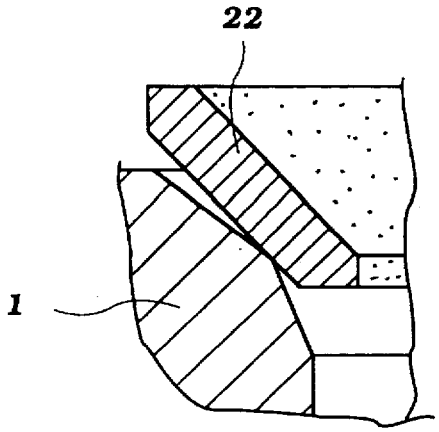
FIG. 9 is a schematic vertical cutaway partial view illustrating another embodiment of arrangement of the cylinder head unit and seat ring member adopted for the present invention.

In the production method in the preferred embodiment, the convex portion 1*a* is provided on the bonding boundary of the cylinder head unit 1. Similarly, the rounded convex portion 22*a* is provided on the bonding boundary of the seat ring member 22. This arrangement is suitable for forming the deformation layer 11 on the side of the cylinder head unit 1. However, the above-described embodiment is to be considered in all respects as only illustrative and not restrictive. As long as the deformation layer 11 can be formed, another arrangement of the cylinder head unit 1 and seat ring member 22 can be adopted such as in FIGS. 7–9.

Valve Seat-Bonding Area

The nature of the above-described metallic bonding (solid-state diffusion) between the cylinder head unit 1 made of aluminum alloy and the seat ring member 22 made of iron-based sintered alloy is essentially different from a mechanical connection resulting in the discontinuous connection of the material which is not associated with the atomic diffusion. Further, it is different from another method of metallic fusion such as the resistance-welding method, wherein both materials are partially melted so as to form an alloy solution by utilizing heat generated by the contact resistance on the surface, and the application of electricity is then discontinued so as to cool the solution.

Namely, the solid-state diffusion in the cylinder head described in the preferred embodiment of the present invention, is characterized by the production of a continuous structure by atomic counter diffusion on the bonding boundary, without forming a melting reaction layer between two different materials, while maintaining the solid phase state of both materials. Thus, the solid-state diffusion (metallic bond) in the present invention is not associated with phase transformation such as melting (fusion) and solidification.

The above-described solid-state diffusion which is not associated with melting and solidification does not require a special welding machine. Rather, it can be achieved with a standard resistance-welding machine by setting conditions of pressure force and electric current as described in FIG. 10.

Figure 12:
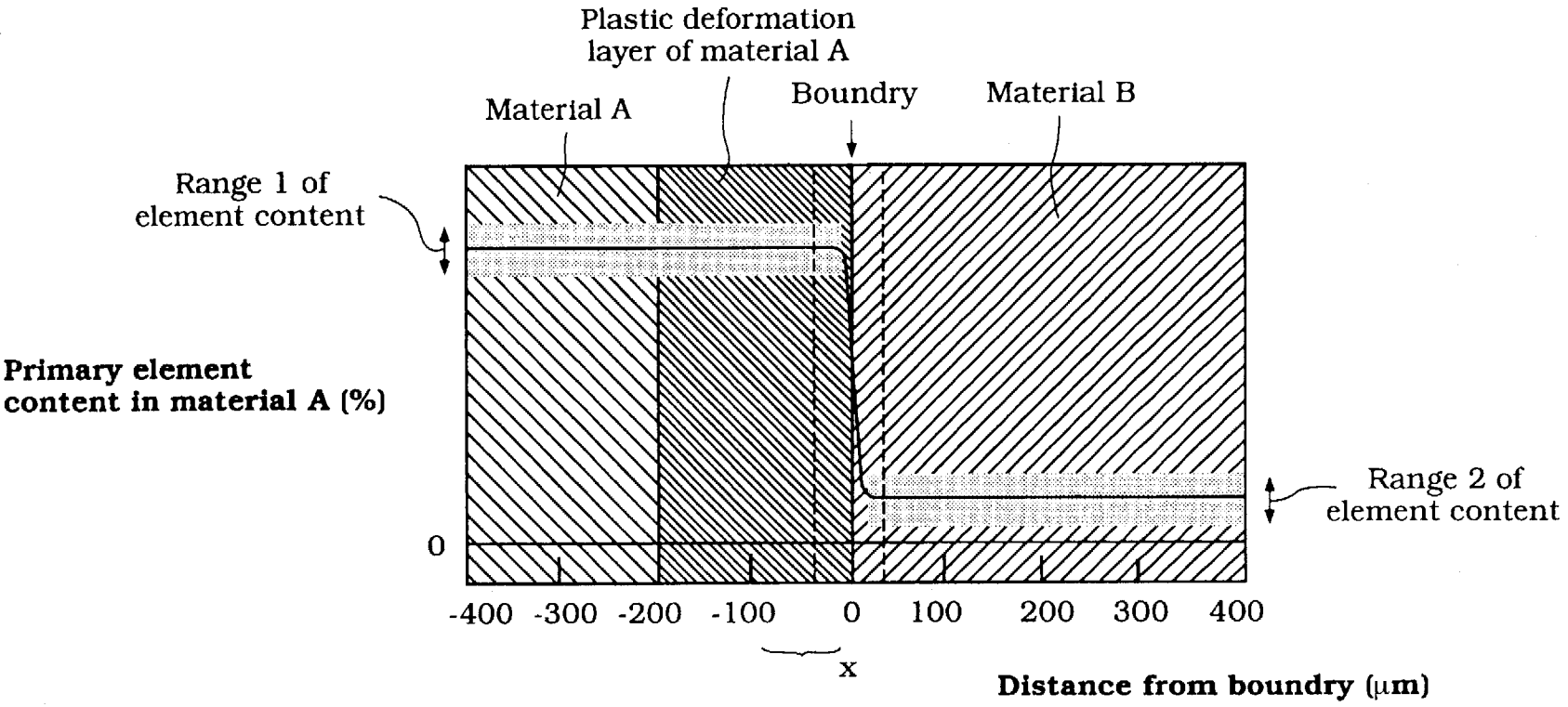
FIG. 12 is an enlarged schematic cross-sectional partial view illustrating a structure of the bonding boundary, in which a plastic deformation layer is formed on the cylinder head unit, and the level of specific chemical compounds is changed in the vicinity of the bonding boundary.
Figure 13:
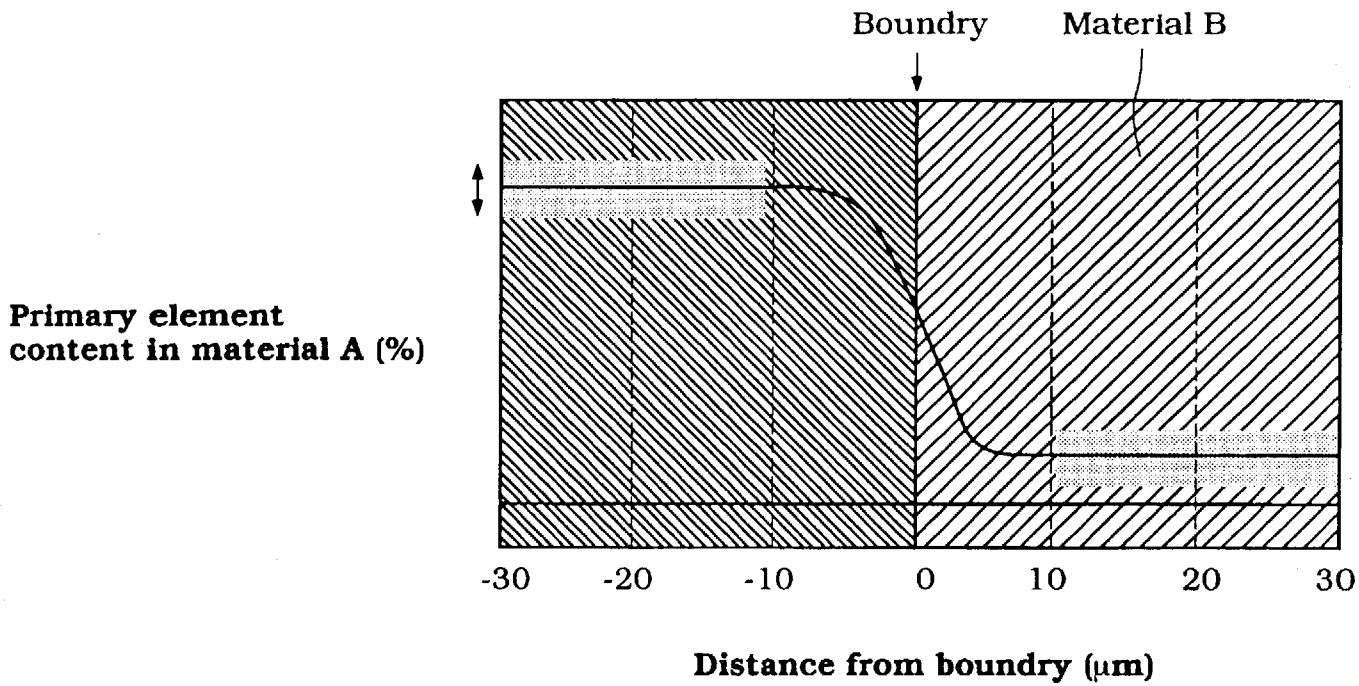
FIG. 13 is a schematic cross-sectional partial view illustrating the enlarged area marked X in FIG. 12.

In the plastic deformation layer 11 formed by the above-described solid-state diffusion on the cylinder head unit 1 along the bonding boundary, specific chemical compounds included therein (Fe, Cu, Ni in aluminum alloy in this embodiment) should be the same as the primary compound (material A) as shown in FIGS. 12 and 13 within a range of 10 μm from the boundary where the plastic deformation layer contacts material B.

Figure 15:
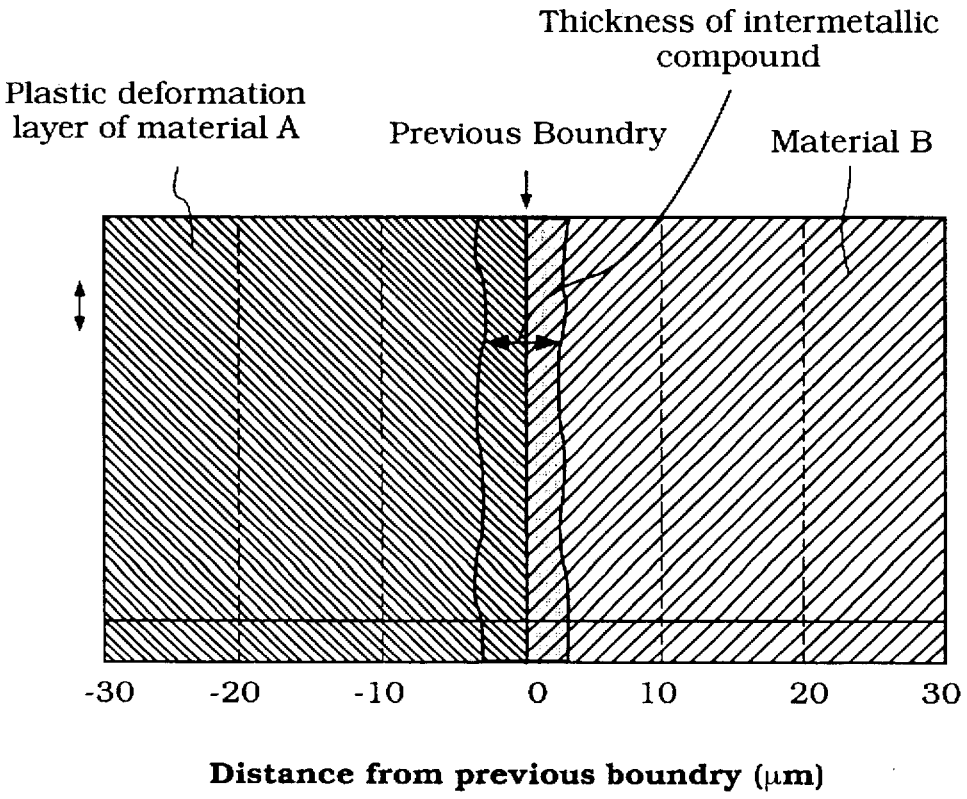
FIG. 15 is a schematic vertical cross-sectional partial view illustrating a structure of the bonding boundary, in which a plastic deformation layer and an intermetallic compound are formed.

Thus, the diffused layer of the specific chemical compound in the vicinity of the bonding boundary of the deformation layer 11 is prevented from expanding. Therefore, even if the engine is running at a high temperature for a long time, the thickness of the compound produced between the deformation layer of material A (deformation layer of the cylinder head unit 1) and material B should be within the range of −10 μm to 10 μm, as shown in FIG. 15.

Figure 14:
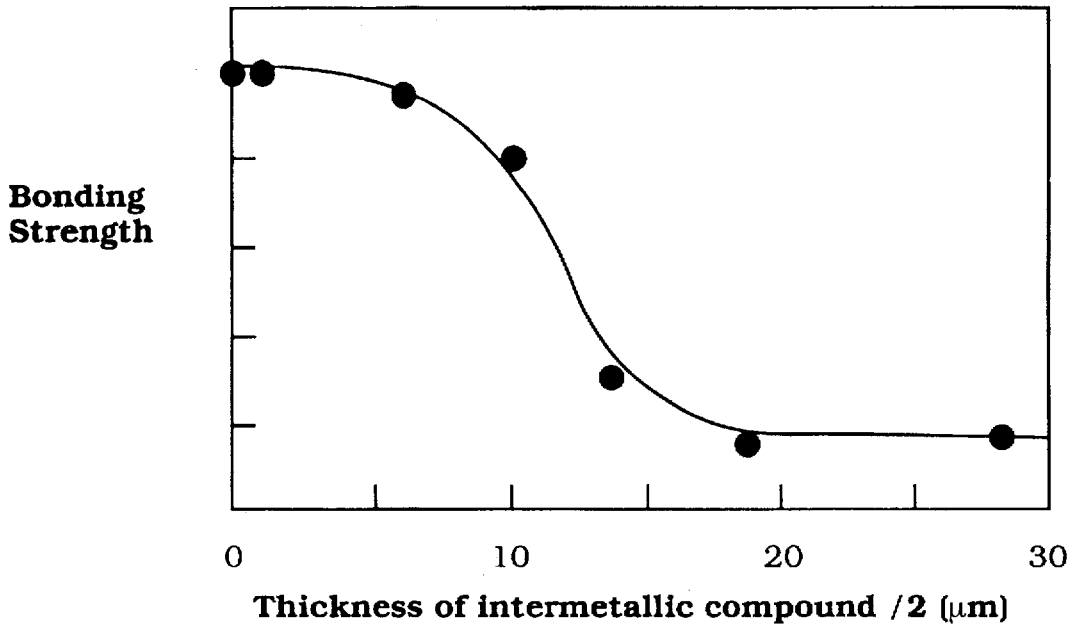
FIG. 14 is a schematic graph illustrating the relationship between the bonding strength and the thickness of an intermetallic compound.

It has been confirmed in the test in FIG. 14 that if the thickness of the compound between the metals is less than 10 μm, connection strength can be consistently maintained.

In view of the connection strength of the bonding boundary, the conventional laser cladding method is associated with the following disadvantage. Namely, in the conventional method, the alloy layer is produced in the range of 200 μm. During the operation at high temperatures, compounds between the metals are produced in the above alloy layer in a wide range, causing weak connection strength.

Figure 16:
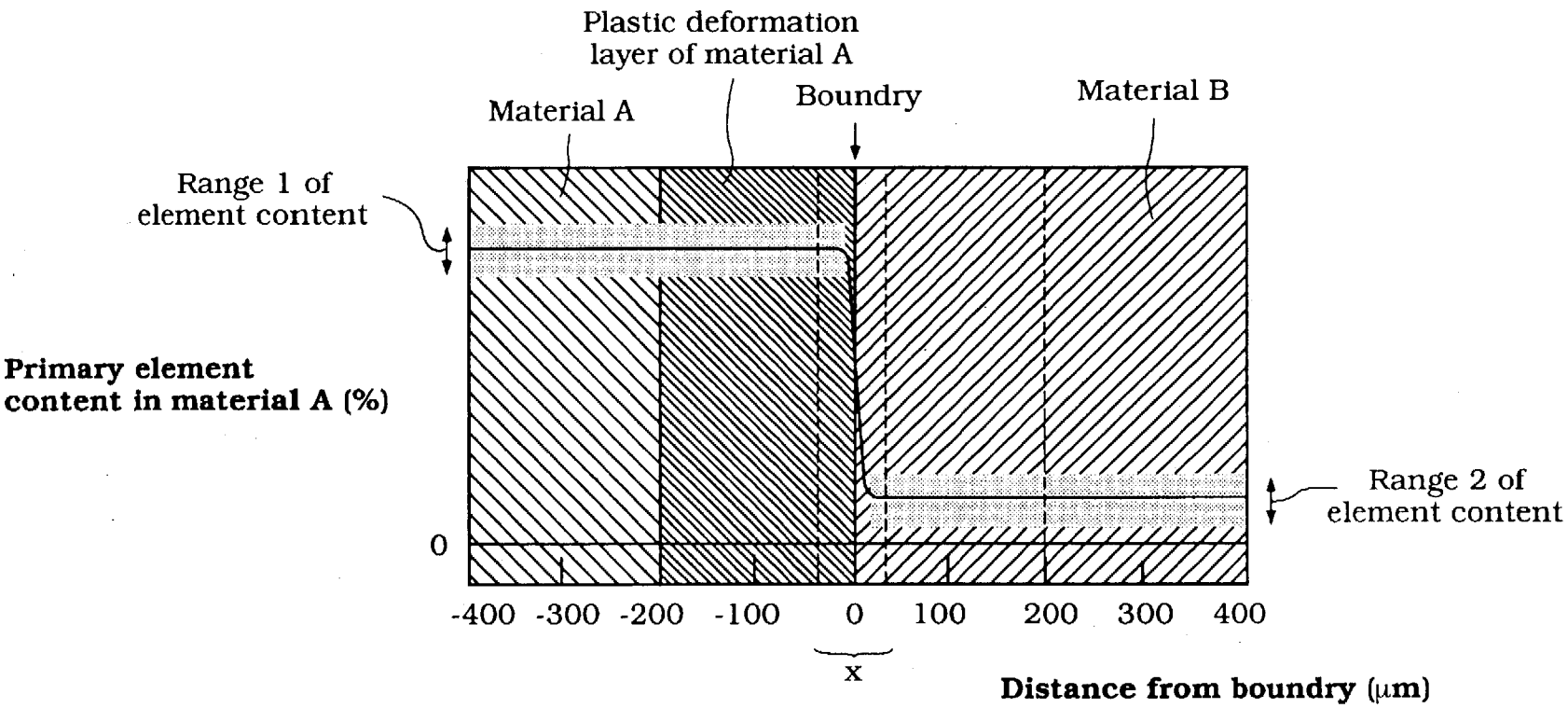
FIG. 16 is a schematic vertical cross-sectional partial view illustrating a structure of the bonding boundary, in which a plastic deformation layers are formed on both sides of the bonding boundary, and the level of specific chemical compounds is changed in the vicinity of the bonding boundary.
Figure 17:
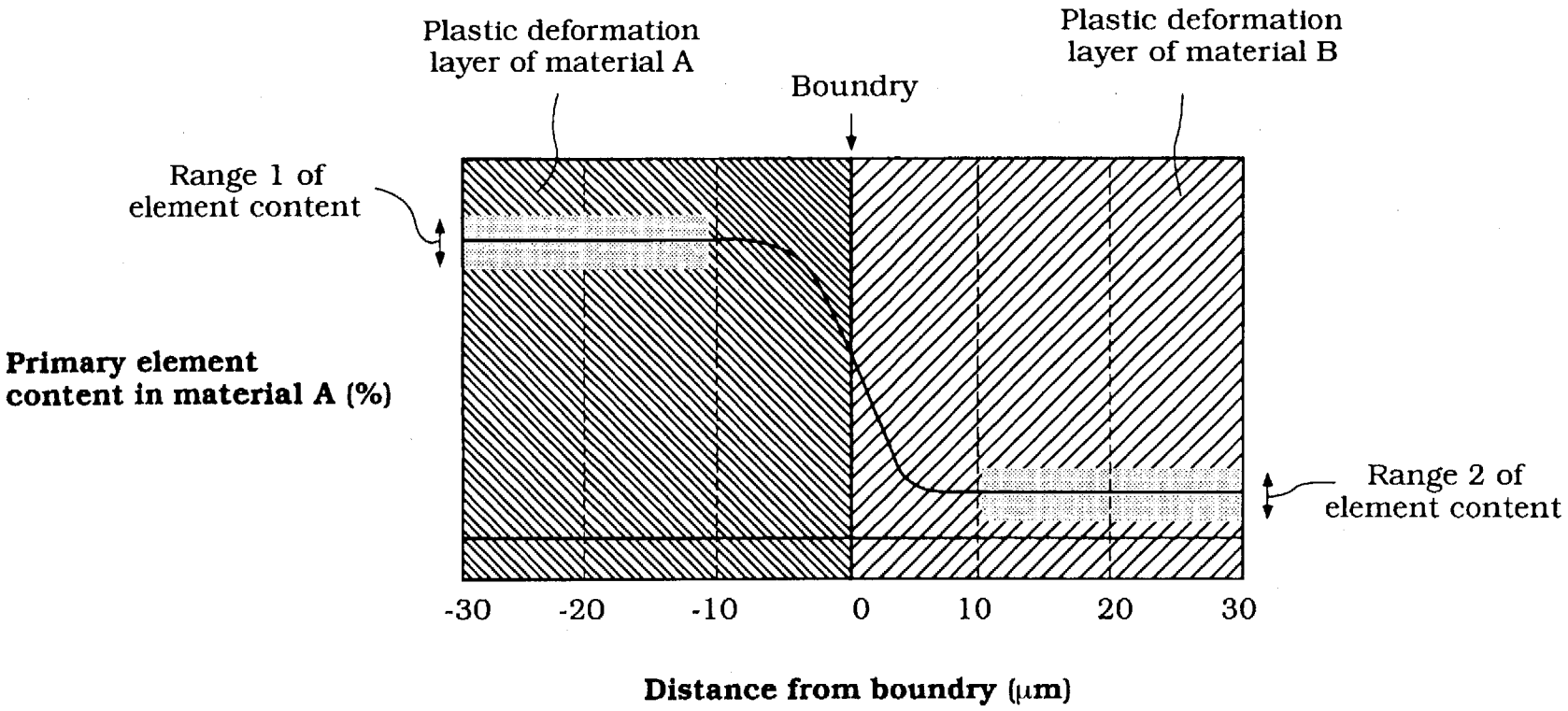
FIG. 17 is a schematic cross-sectional partial view illustrating the enlarged area marked X in FIG. 16.

In the preferred embodiment, the deformation layer 11 is formed only at the side of the cylinder head unit 1. However, the deformation layer 11 may be formed at the side of the valve seat, depending on the material of the seat ring member. In this case, as shown in FIGS. 16 and 17, for the deformation layer of material B (deformation layer at the side of the seat ring member), the specific chemical compounds included therein should be the same as the primary compound (material B) within a range of 10 μm from the bonding boundary.

Figure 33:
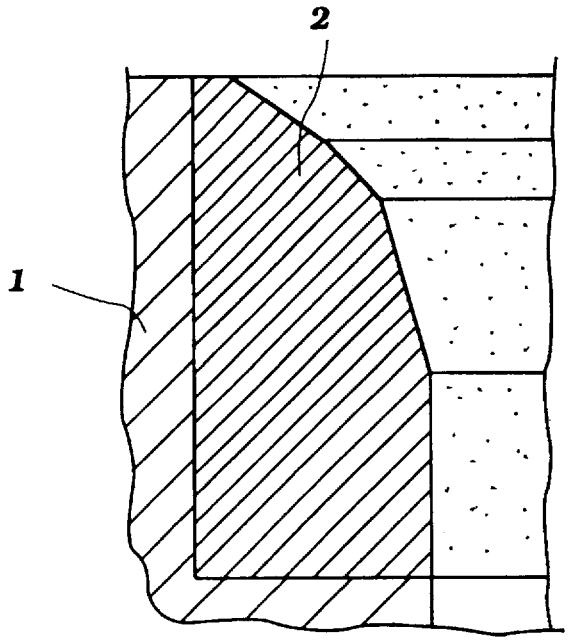
Figure 33 Prior Art
FIG. 33 is a schematic vertical cutaway partial view illustrating a bonding area of the prior art formed by physical attachment.

According to the present invention, the cross-sectional area of the valve seat 2 can be reduced, in comparison with the valve seat which is pressingly formed as shown in FIG. 33. As a result, it allows more flexible design for the vicinity of the port of the cylinder head unit. It can also avoid the problem associated with the heat transmitted to the valve seat 2 when heat is transmitted to the cylinder head unit 1 from the valve face or exhaust air. It can further avoid the associated abnormal combustion, abrasion and damage caused to the valve and valve seats due to thermal deterioration.

Figure 34:
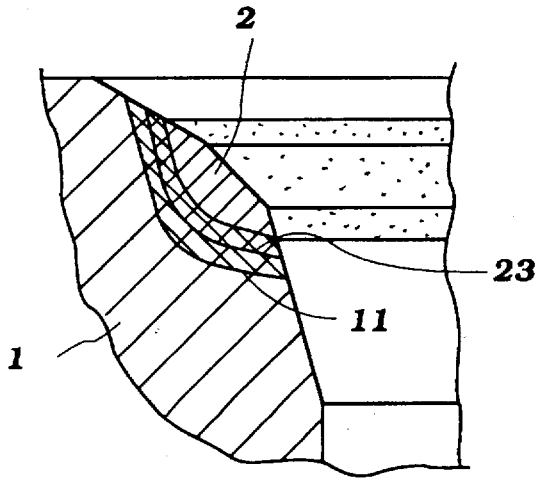
Figure 34 Prior Art
FIG. 34 is a schematic vertical cutaway partial view illustrating a bonding area of the prior art formed by the laser cladding technique.

In comparison with the valve seat formed by the laser cladding method as shown in FIG. 34, a melted reaction layer 23 is not formed in the vicinity of the bonding boundary of the cylinder head unit 1. Thus, a blow hole or a shrinkage cavity will not be caused in the vicinity of the bonding boundary 12 between the cylinder head unit 1 and valve seat 2. Furthermore, since the cylinder head unit 1 is sufficiently deformed, an oxide film on the surface of the aluminum alloy is completely destroyed, allowing the atomic counter diffusion to cast on the entire surface. Therefore, due to sufficient bonding strength, the valve seat is unlikely to be dropped during engine operation.

Moreover, like the primary compound, the specific chemical compounds (Fe, Cu, Ni) included in the deformation layer 11 formed on the cylinder head unit 1 do not diffuse beyond a certain range. In the present invention, since the thickness of the compound between the metals does not exceed the range of 10 μm from the bonding boundary, the connection strength is highly reliable even during operation at high temperatures for long periods of time.

Furthermore, according to the method of the present invention, wherein the convex portion 1*a* and rounded convex portion 22*a* are formed respectively on the cylinder head unit 1 and seat ring member 22 as shown in FIG. 3, the cylinder head unit 1 is sufficiently deformed by pressing the seat ring member 22 against the cylinder head unit 1.

EXAMPLE 2

Use Of Valve Seat Coated With Cu Layer

Valve Seat-Bonded Cylinder Head

Other embodiments of the present invention will be described below with reference to the figures.

Figure 22:
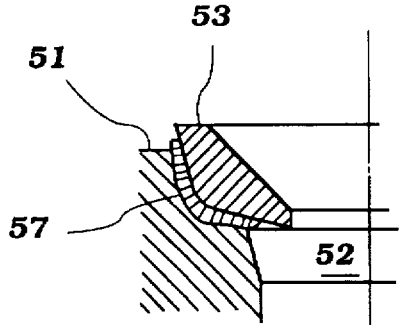
FIG. 22 is a schematic vertical cutaway half view illustrating one embodiment of the step of releasing pressure from the valve seat.
Figure 23:
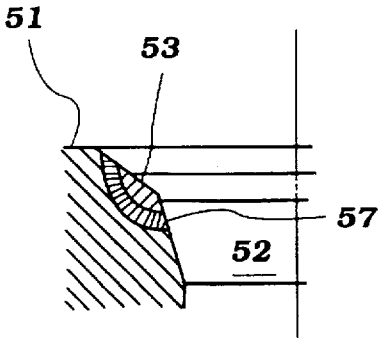
FIG. 23 is a schematic vertical cutaway half view illustrating one embodiment of the step of machining the valve seat.
Figure 24:
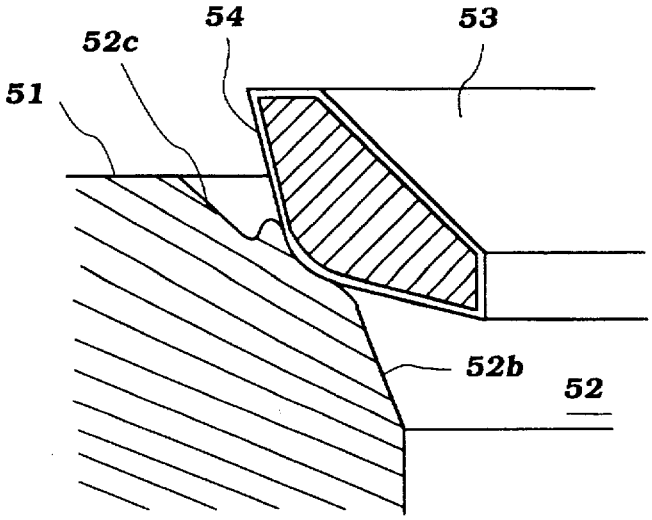
FIG. 24 is an enlarged schematic vertical cross-sectional view illustrating the area enclosed by circle A in FIG. 19.
Figure 25:
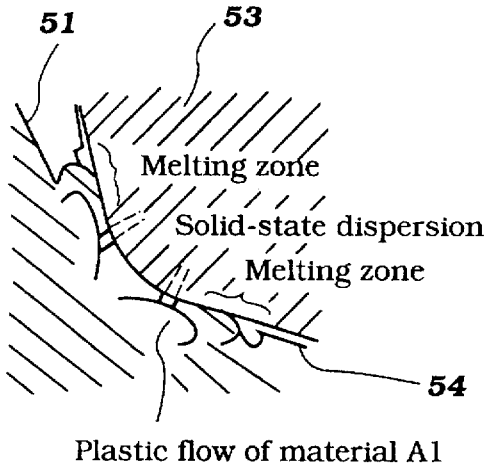
FIG. 25 is an enlarged schematic vertical cross-sectional view illustrating the mechanism of solid-state diffusion in the area enclosed by circle B in FIG. 20.
Figure 26:
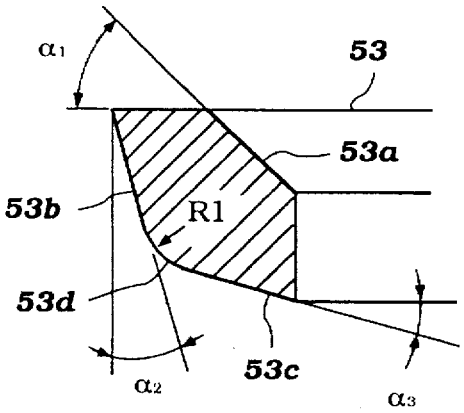
FIG. 26 is a schematic vertical cross-sectional view illustrating one embodiment of a shape of the valve seat.
Figure 27:
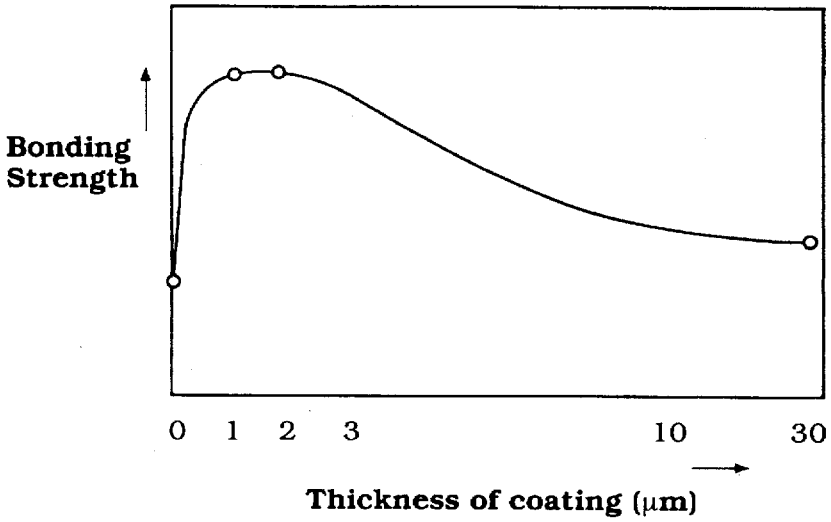
FIG. 27 is a schematic graph illustrating the relationship between the bonding strength and the thickness of a coating film.
Figure 28:
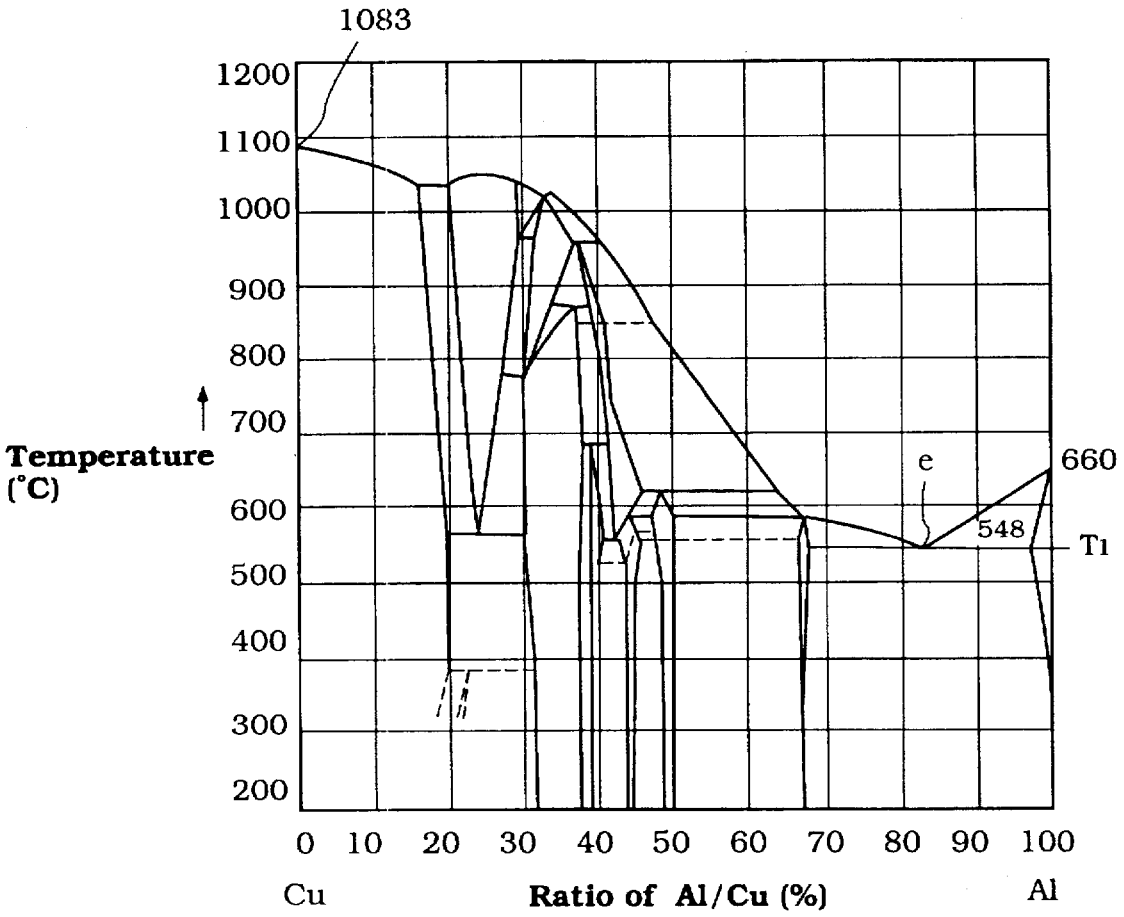
FIG. 28 is a state diagram illustrating the relationship between the temperature and the ratio of Al to Cu with respect to formation of an eutectic alloy.

FIG. 18 to FIG. 23 are the cross-sectional views which explain the bonding process of the valve seat (welding-type) related to the present invention. The valve seat is made of an Fe-based sintered alloy impregnated with Cu. FIG. 24 illustrates an enlarged view of part A of FIG. 19. FIG. 25 illustrates an enlarged view of part B of FIG. 20. FIG. 26 is the cross-sectional shape of the valve seat. FIG. 27 illustrates the relation between bonding strength and coating film thickness. FIG. 28 illustrates the state of Al-Cu alloy.

Figure 18:
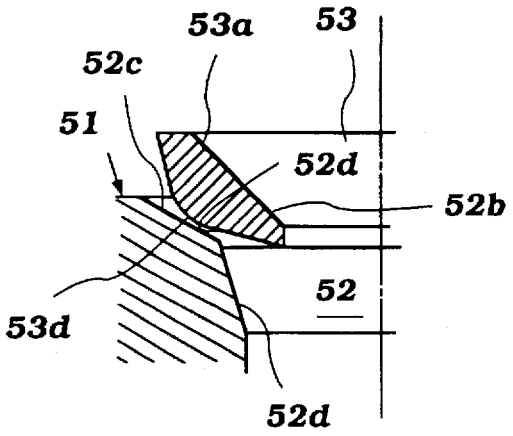
FIG. 18 is a schematic vertical cutaway half view illustrating one embodiment of the step of placing a valve seat member on a cylinder head unit.

In FIG. 18, the cylinder head 51 is made of lightweight Al alloy, and the ring-shaped tapered surface 52*a*, 52*b* and 52*c* which extend upward are formed around the edge of a port 52 of the cylinder head 51. Moreover, in FIG. 18, the valve seat 53 of the present invention has the coating film 54 (see FIG. 24), the thickness of which is between 0.1 μm and 30 μm, on the surface of the ring-shaped primary compound made of Fe-based sintered alloy which has the superiority of shock-resistance, wear-resistance, and hardness at a high temperature. Pores of Fe-based sintered alloy, which is the primary material of the valve seat 53, are filled with a material such as Cu with good heat-conductivity and self-lubrication by immersing it.

FIG. 26 illustrates a detailed cross-sectional view of the valve seat 53. The tapered surface 53*a* (angle $\alpha_1$=45°) is formed at the inside circumferential surface of the valve seat. The tapered surfaces 53*b* and 53*c* (angle $\alpha_1$=15°) are formed at the external circumferential surface. The R1 (diameter is 1 mm) rounding processing is made at the projection 53*d* where the tapered surface 53*d* crosses 53*c*.

As the material of the coating film 54, a material is selected which forms an eutectic alloy between Al and a compound or primary compound element of the coating film. The eutectic alloy has a lower melting point than that of Al, the primary compound element of the Al alloy used as the material of the cylinder head, as well as that of the compound or primary compound element of the coating film 54. Cu was used as the material in this embodiment. Although coating film 54 of Cu was formed by electric plating in this embodiment, the coating film could be formed by non-electrolytic plating, or flame coating method.

As shown in FIG. 28 which illustrates the state of Al—Cu alloy, while the melting points of Al and Cu are 660° C. and 1083° C. respectively, the temperature T1 at the eutectic point of Al—Cu alloy is 548° C., which is lower than the melting point of Al or Cu (660° C. and 1083° C.). Therefore, Cu, the material of the coating film 54, forms an eutectic alloy between itself and Al, the primary compound of the cylinder head.

Figure 19:
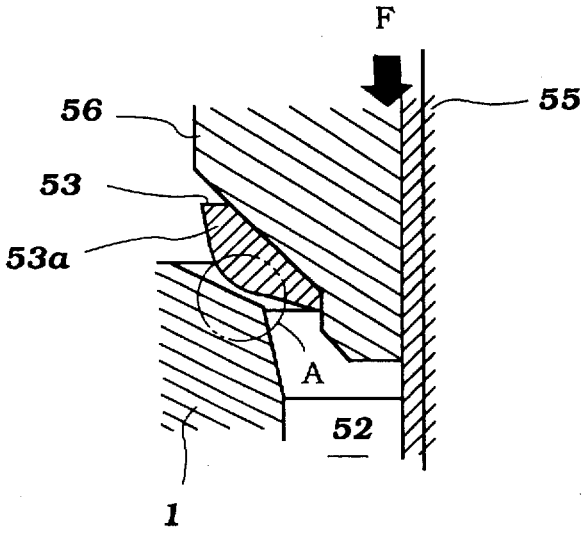
FIG. 19 is a schematic vertical cutaway half view illustrating one embodiment of the step of pressing the valve seat against the cylinder head unit.
Figure 20:
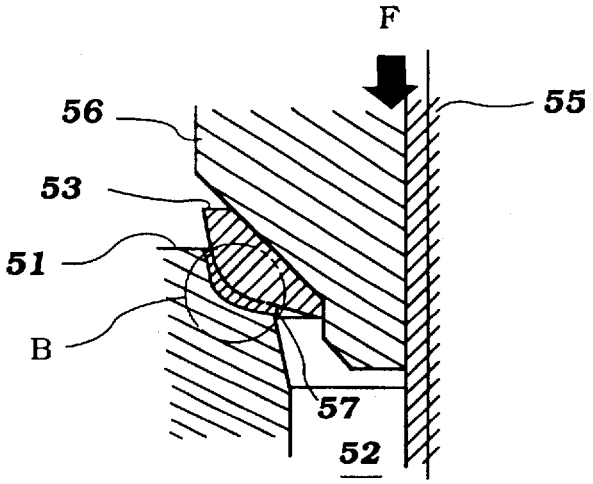
FIG. 20 is a schematic vertical cutaway half view illustrating one embodiment of the step of impressing a voltage between the valve seat and the cylinder head unit.
Figure 21:
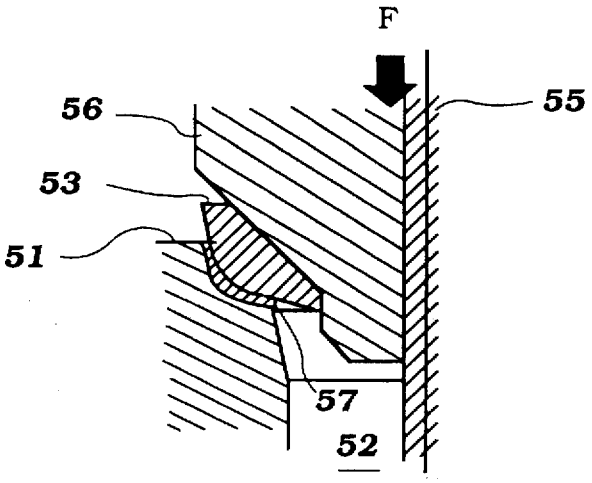
FIG. 21 is a schematic vertical cutaway half view illustrating one embodiment of the step of discontinuing impression of a voltage.

FIG. 18 to FIG. 25 will be used to describe the bonding process of the valve seat 53 to the cylinder head 51. As shown in FIG. 18, the valve seat is set in place so that the projection 53*d* of the external circumferential surface of the valve seat touches the projection 52*d* of the circumference of the port 52 of the cylinder head 51. As shown in FIG. 19, an electrode 56 of the resistance-welding machine, which slides up and down along the guide bar 55, is fitted into the inside circumferential surface 53*a*. The valve seat 53 is pressed into the cylinder head 51 with a certain force F of the electrode 56. The Al alloy, the material of the cylinder head 51 and Cu, the material of the coating film 54 are then pressed against each other. FIG. 24 illustrates the state of the point of contact between the valve seat 53 and the cylinder head 51. When a voltage is impressed on the valve seat 53 through the electrode 56 under compression depicted in FIG. 19, an electric current flows from the valve seat 53 to the cylinder head 51, thereby heating the contacting area as well as the vicinity thereof. Resulting from activated atomic movement due to an elevated temperature, mutual diffusion between the Cu atoms and the Al atoms at the contacting area occurs, followed by generation of a diffusion layer having a Cu—Al alloy composition. However, because the valve seat 53 is constantly pressed against the contacting surface of the cylinder head 51, at a temperature sufficient to generate a liquid state of the Cu—Al alloy, in such a way that the boundary region of the cylinder head undergoes plastic deformation, the formed Cu—Al alloy (eutectic alloy) is repelled completely from the contacting surface while the Al material of the cylinder head 51 causes a plastic flow along the contacting surface in the direction indicated by the arrow in FIG. 25. While being repelled, the flowing alloy functions as a lubricant, and contributes to formation of diffusion bonding between the Al atoms and the Cu atoms on the contacting surface. No melting reaction layer such as the above alloy can be left between the valve seat and the cylinder head. As a result, bonding by solid-state diffusion is achieved on the molecular level on the contacting surface, and thus, the diffusing material is not the Al—Cu alloy. Bonding by solid-state diffusion can be achieved between Al-based material in the cylinder head and Fe-based material in the valve seat without Cu, but bonding strength tends to be lowered. After completing bonding between the valve seat 53 and the cylinder head 51 based on the above mechanisms, an electric current is discontinued. As a result, a plastic deformation layer 57 of Al is formed on the bonding boundary between the valve seat 53 and the cylinder head 51, and a substance solidified from the liquid-state material (Al—Cu alloy) which has been repelled from the bonding boundary is formed along the edge of the bonding boundary, as depicted in FIG. 21.

As shown in FIG. 22, the electrode 56 is removed, and the pressure applied to the valve seat 53 is released. The valve seat 53 is then processed and finished by a machine into a predetermined shape as shown in FIG. 23. Thus, the bonding operation of the valve seat 53 on the cylinder head 51 is completed, whereby the valve seat 53 is securely bonded to the rim of the port 52 of the cylinder head 51.

Effects Of Thickness Of Coating Layer

Figure 29:
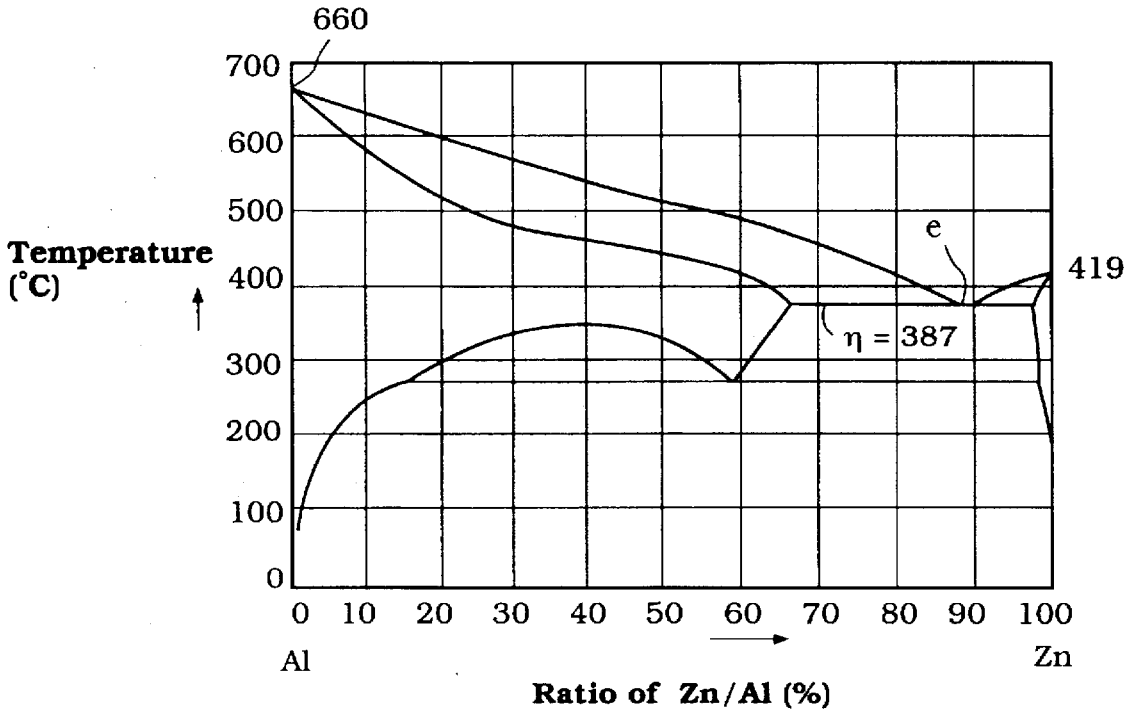
FIG. 29 is a state diagram illustrating the relationship between the temperature and the ratio of Zn to Al with respect to formation of an eutectic alloy.
Figure 30:
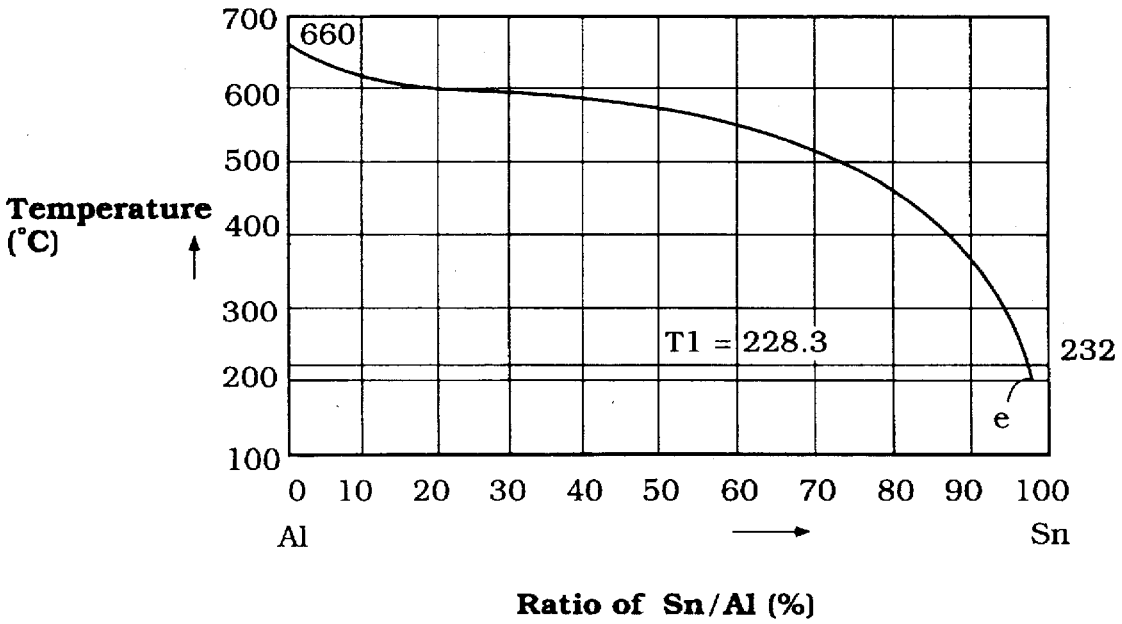
FIG. 30 is a state diagram illustrating the relationship between the temperature and the ratio of Sn to Al with respect to formation of an eutectic alloy.
Figure 31:
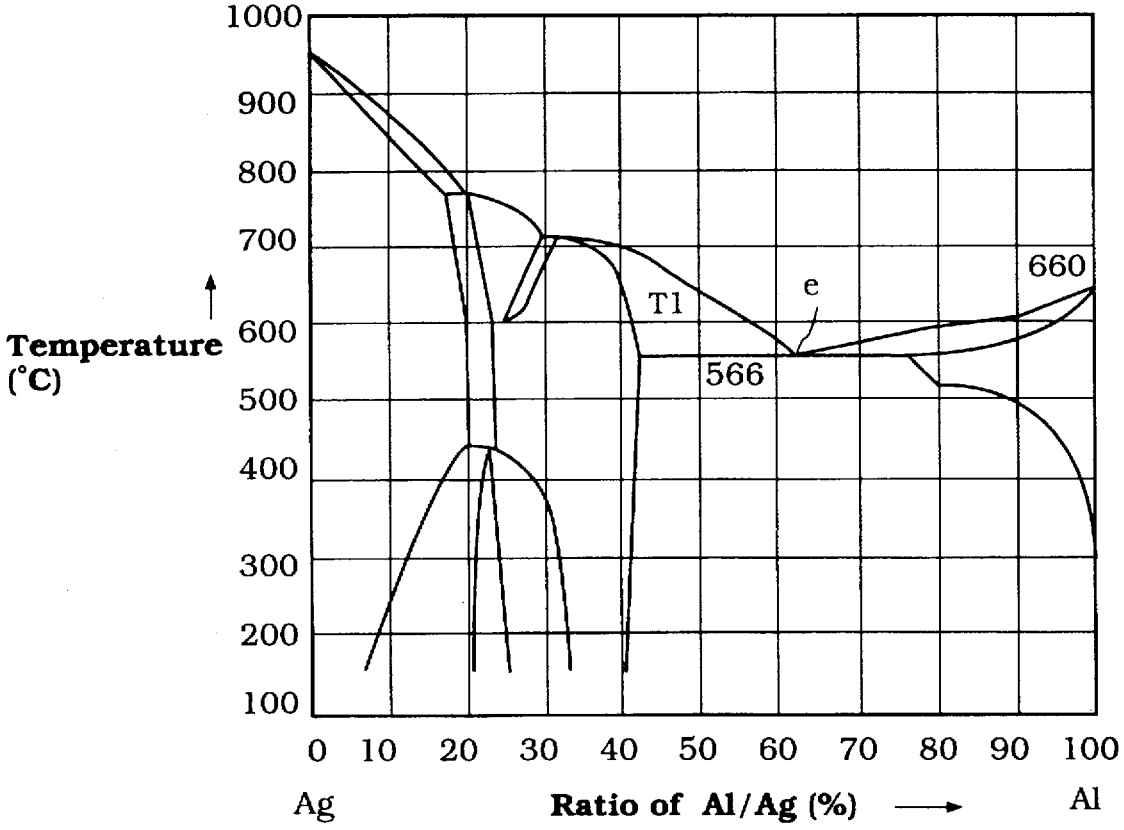
FIG. 31 is a state diagram illustrating the relationship between the temperature and the ratio of Al to Ag with respect to formation of an eutectic alloy.
Figure 32:
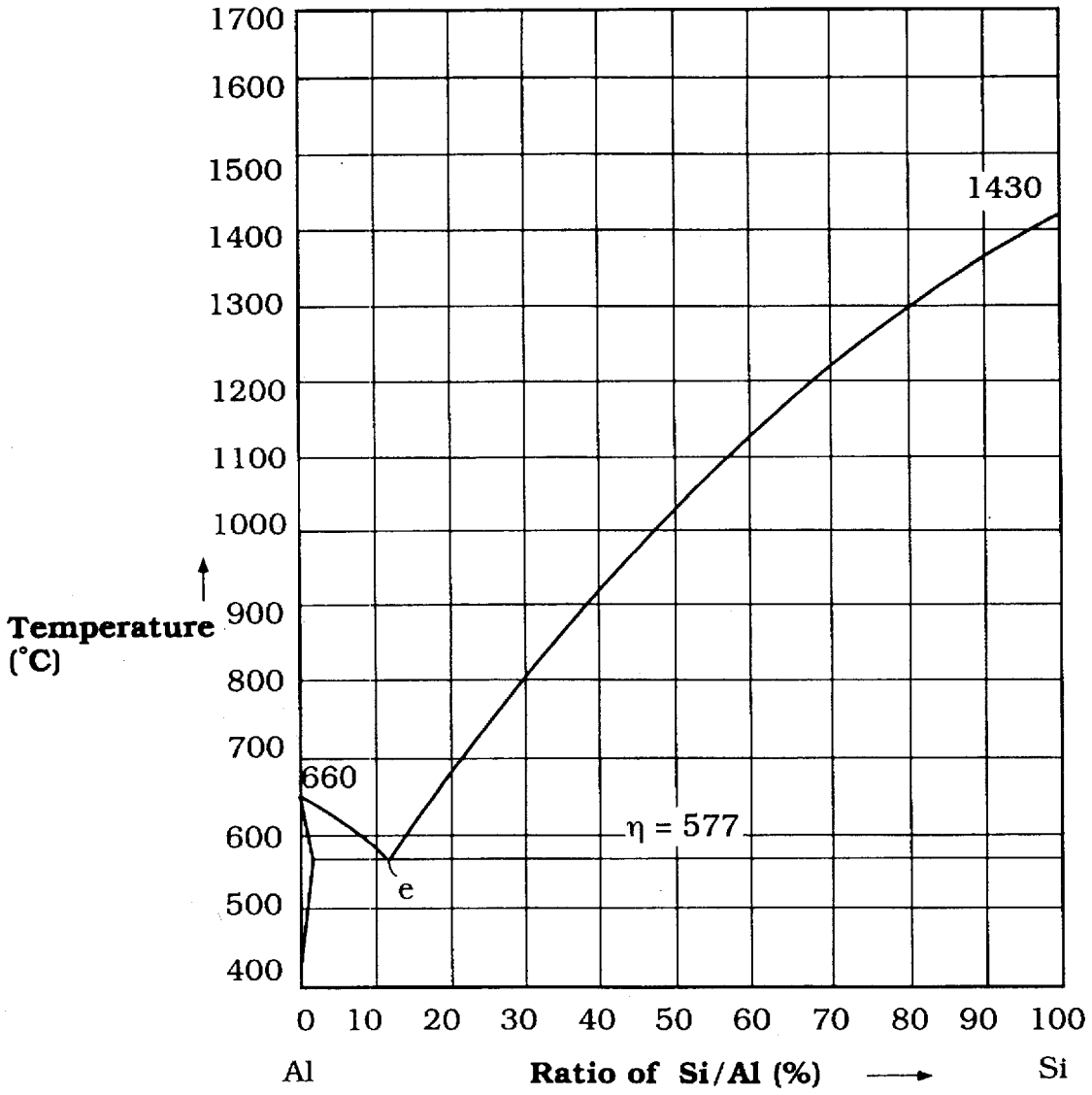
FIG. 32 is a state diagram illustrating the relationship between the temperature and the ratio of Si to Ag with respect to formation of an eutectic alloy.

FIG. 27 is a graph illustrating the measurements of the bonding strength of the valve seat 53 at varying thicknesses of the coating film 54. According to FIG. 27, the bonding strength of the valve seat 53 is high when the thickness of the coating film 54 is in a range of 0.1 μm–3 μm. Thus it was confirmed that the thickness of the coating film 54 should be in a range of 0.1 μm–30 μm in order to obtain sufficient bonding strength. In addition to copper (Cu), other materials such as zinc (Zn), tin (Sn), silver (Ag) and silicon (Si) can be used for producing the coating film 54. FIGS. 29–32 are diagrams illustrating the relationships between the temperature and proportion of alloy. FIG. 29 illustrates an example of Al—Zn alloy. FIG. 30 illustrates an example of Al—Sn alloy. FIG. 31 illustrates an example of Al—Al alloy. FIG. 32 illustrates an example of Al—Si alloy.

In the graph in FIG. 29, the melting points of Al and Zn are 660° C. and 419° C. respectively. Conversely, a temperature $T_1$ at the eutectic point of the Al—Zn alloy is 382° C., which is lower than each of the melting points of Al and Zn.

In the graph in FIG. 30, the melting points of Al and Sn are respectively 660° C. and 232° C. Conversely, a temperature $T_1$ at the eutectic point of the Al—Sn alloy is 228.3° C., which is lower than each of the melting points of Al and Sn.

In the graph in FIG. 31, the melting points of Ag and Al are 950.5° C. and 660° C. respectively. Conversely, a temperature $T_1$ at an eutectic point of the Al—Sn alloy is 566° C., which is lower than each of the melting points of Ag and Al.

Similarly, in the graph in FIG. 32, the melting points of Al and Si are 660° C. and 1430° C. respectively. Conversely, a temperature $T_1$ at the eutectic point of the Al—Sn alloy is 577° C., which is lower than each of the melting points of Al and Si.

Therefore, in the present invention, the coating film can be preferably made from an alloy which is mainly comprised of the above-described materials such as Zn, Sn, Ag and Si.

Moreover, in addition to the foregoing methods of producing the coating film on the surface of the valve seat (electric plating, non-electrolytic plating, flame coating method), hot-dipping plating, physical deposition, chemical deposition, and other coating methods can be employed. The number of valve seat installed in a valve seat-bonded cylinder head of the present invention should not be restricted, i.e., at least one, preferably two to four.

The valve seat-bonded cylinder head of the present invention has desirably been formed in connection with a method for affixing a valve seat into a cylinder head under compression, the details of which are set forth in a U.S. patent application entitled "Valve Seat," Ser. No. 08/278,026, filed on Jul. 20, 1994 (claiming priority from Japanese Patent Application No. 200325, filed Jul. 20, 1993 and No. 250559, filed Oct. 6, 1993), which is hereby incorporated herein by reference.

We claim:

1. A valve seat-bonded cylinder head comprising a cylinder head unit being comprised of a first material and having a flow passage extending therethrough, said flow passage terminating at one end in a combustion chamber surface, and at least one valve seat insert bonded to said cylinder head unit at said combustion chamber surface, said valve seat insert being formed of material different from and harder than that of said cylinder head unit material, wherein said valve seat insert is bonded to said cylinder head unit by solid-state diffusion, without forming an alloy between the base materials of said cylinder head unit and said valve seat insert, and a plastic deformation layer is formed on the bonding boundary at least in the cylinder head unit material.

2. The valve seat-bonded cylinder head according to claim 1, wherein said valve seat insert material is impregnated with metal deposits capable of forming an eutectic alloy with the material of said cylinder head unit.

3. The valve seat-bonded cylinder head according to claim 2, wherein said metal deposits and the material of said cylinder head unit have undergone solid-state diffusion.

4. The valve seat-bonded cylinder head according to claim 1, wherein the chemical composition present in said plastic deformation layer is substantially constant in a region in said plastic deformation layer further than 10 μm from said bonding boundary in perpendicular direction with respect to the plane of said bonding boundary.

5. The valve seat-bonded cylinder head according to claim 4, wherein an intermetallic compound layer is formed in a region within 10 μm of said bonding boundary.

6. The valve seat-bonded cylinder head according to claim 5, wherein the thickness of said intermetallic compound layer is 10 μm.

7. The valve seat-bonded cylinder head according to claim 2, wherein said cylinder head unit is made of an aluminum alloy, the valve seat insert impregnation material includes components selected from the group consisting of Fe, Cu and Ni.

8. The valve seat-bonded cylinder head according to claim 1, wherein said valve seat insert is formed of an Fe-based sintered alloy.

9. The valve seat-bonded cylinder head according to claim 2, wherein said metal deposits are composed of Cu.

10. A method for producing a valve seat-bonded cylinder head, in which at least valve seat is bonded to a cylinder head unit, said valve seat and said cylinder head unit being formed of different materials, said method comprising the steps of placing at least one valve seat insert having a convex surface as a bonding surface on a convex surface of a cylinder head unit, in which said convex surface of said valve seat insert is to be attached to said convex surface of said cylinder head insert; impressing a voltage between said convex surface of said valve seat insert and that of said cylinder head unit while pressing said valve seat insert against said cylinder head unit to form a plastic deformation layer on the joining boundary at least on said cylinder head unit for bonding said valve seat insert and said cylinder head unit by solid-state diffusion, without forming an alloy reaction layer between the base materials of said valve seat insert and said cylinder head unit; cooling the resulting cylinder head unit to which said valve seat insert has been bonded; and machining the resulting valve seat-bonded cylinder head.

11. The method for producing a valve seat-bonded cylinder head according to claim 10, wherein said convex surface of said cylinder head unit is rounded.

12. The method for producing a valve seat-bonded cylinder head according to claim 10, wherein said valve seat insert material is impregnated with metal deposits capable of forming an eutectic alloy with said cylinder head unit.

13. The method for producing a valve seat-bonded cylinder head according to claim 12, wherein said metal deposits and the material of said cylinder head unit undergo solid-state diffusion.

14. The method for producing a valve seat-bonded cylinder head according to claim 10, wherein said valve seat insert is impregnated with Cu.

15. The method for producing a valve seat-bonded cylinder head according to claim 12, wherein said valve seat insert is coated with said metal deposits.

16. The method for producing a valve seat-bonded cylinder head according to claim 15, wherein the thickness of the coating of said metal deposits is 1–30 μm.

17. The method for producing a valve seat-bonded cylinder head according to claim 10, wherein said cylinder head unit is formed of an aluminum alloy, and said valve seat insert material is impregnated with components selected from the group consisting of Fe, Cu and Ni.

18. The method for producing a valve seat-bonded cylinder head according to claim 10, wherein said valve seat insert is formed of an Fe-based sintered alloy.

19. The method for producing a valve seat-bonded cylinder head according to claim 12, wherein said metal deposits are composed of Cu.

20. A valve seat-bonded cylinder head according to claim 1, wherein the plastic deformation layer of the cylinder head is work hardened.

21. The method for producing a valve seat-bonded cylinder head according to claim 10, wherein the plastic deformation layer of the cylinder head is work hardened.

22. The method for producing a valve seat-bonded cylinder head according to claim 12, wherein the eutectic alloy formed by the metal deposits and the cylinder head unit are displaced from the area between the valve seat insert and the cylinder head unit and which eutectic alloys are machined away during the machining step.

23. The method for producing a valve seat-bonded cylinder head according to claim 10, wherein an initial pressing force is applied prior to the impressing of the current flow.

24. A method for producing a valve seat-bonded cylinder head as set forth in claim 10, wherein the impressed current flow is gradually built up to a first level and then is reduced during the continued pressing operation.

25. The method for producing a valve seat-bonded cylinder head according to claim 24, wherein the current flow is raised to the first level, reduced below the first level, and then subsequently increased to a second level during the pressing operation.

26. The method for producing a valve seat-bonded cylinder head according to claim 25, wherein the second level of current flow is lower than the first level of current flow.

27. The method for producing a valve seat-bonded cylinder head according to claim 24, wherein the pressing pressure is increased when the current flow is elevated to the first value.

28. The method for producing a valve seat-bonded cylinder head according to claim 27, wherein the pressing pressure is held substantially constant during the remainder of the electrical heating.

* * * * *